US005882846A

United States Patent [19]

Vacca et al.

[11] Patent Number: 5,882,846

[45] **Date of Patent: *Mar. 16, 1999**

[54] INFRARED SENSITIVE PHOTOGRAPHIC ELEMENTS

[75] Inventors: Alberto Vacca, Carcare; Marino Rossi, Pallare, both of Italy

[73] Assignee: Imation Corp., Oakdale, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 1,854

[22] Filed: Jan. 8, 1993

[30] Foreign Application Priority Data

Feb. 13, 1992 [IT] Italy ..... MI92A0299

[51] Int. Cl.[6] ..... G03C 1/20; G03C 1/76; G03C 5/16

[52] U.S. Cl. ..... 430/538; 430/523; 430/539; 430/584; 430/944; 430/950; 430/961; 430/631

[58] Field of Search ..... 430/523, 944, 430/507, 508, 584, 950, 539, 631, 961, 538

[56] References Cited

U.S. PATENT DOCUMENTS

| | | | |
|---|---|---|---|
| 3,053,662 | 9/1962 | Mackey et al. | 430/527 |
| 3,591,379 | 7/1971 | Plakunov | 430/961 |
| 4,190,449 | 2/1980 | Naoi et al. | 434/961 |
| 4,232,117 | 11/1980 | Naoi et al. | 430/539 |
| 4,264,719 | 4/1981 | Kamecka et al. | 430/961 |
| 4,619,892 | 10/1986 | Simpson et al. | 430/505 |
| 4,711,838 | 12/1987 | Grzeskowiak et al. . | |
| 4,777,113 | 10/1988 | Inoue et al. | 430/961 |
| 4,847,191 | 7/1989 | Grzeskowiak | 430/605 |
| 4,906,553 | 3/1990 | Ikegawa et al. | 430/401 |
| 4,975,362 | 12/1990 | Parton et al. | 430/584 |
| 4,999,282 | 3/1991 | Sato et al. | 430/569 |
| 5,013,642 | 5/1991 | Muenter et al. | 430/584 |
| 5,061,618 | 10/1991 | Parton et al. | 430/584 |
| 5,108,872 | 4/1992 | Inoue et al. | 430/264 |
| 5,149,619 | 9/1992 | Mihara et al. | 430/584 |
| 5,227,286 | 7/1993 | Kuno et al. | 430/523 |
| 5,300,411 | 4/1994 | Sterman et al. | 430/961 |

FOREIGN PATENT DOCUMENTS

| | | |
|---|---|---|
| 0 334 400 | 9/1989 | European Pat. Off. . |

*Primary Examiner*—Janet C. Baxter
*Attorney, Agent, or Firm*—William K. Weimer

[57] ABSTRACT

Infrared sensitive photographic elements comprise an opaque film support, an infrared sensitized silver halide emulsion layer and a hydrophilic colloid protective layer on one side of the film support, said protective layer comprising colloidal silica having an average particle size lower than 15 nanometers.

The elements have an increased exposure latitude upon exposure to infrared laser diodes, and higher maximum density upon photographic processing.

8 Claims, No Drawings

INFRARED SENSITIVE PHOTOGRAPHIC ELEMENTS

FIELD OF THE INVENTION

The present invention relates to infrared sensitive silver halide photographic elements, and in particular to infrared sensitive silver halide photographic elements intended for exposure to infrared laser diodes.

BACKGROUND OF THE INVENTION

Silver halides have been widely used as the light sensitive components in photographic elements. Upon exposure of the silver halides to light, a latent image is formed which is then developed during the photographic processing to form a visible image. Silver halides are intrinsically sensitive only to light in the blue region of the visible spectrum. To impart to silver halides sensitivity to other wavelengths of radiation, visible such as green or red as well as invisible such as infrared, spectral sensitizing dyes, such as cyanine dyes, are used in photographic elements. Said sensitizing dyes, adsorbed to the surface of silver halide grains, absorb light or radiation of a particular wavelength and transfer the absorbed energy to the silver halide to form a latent image.

Dyes which have been capable of sensitizing silver halides to infrared regions of the electromagnetic spectrum have been known for many years. Cyanine and merocyanine dyes, particularly those with longer bridging groups between cyclic moieties have been used for many years to sensitize silver halide to the infrared. U.S. Pat. Nos. 3,619,154; 3,682,630; 2,895,955; 3,482,978; 3,758,461; 4,515,888 and 2,734,900, and GB Pat. Nos. 1,192,234 and 1,188,784 disclose well-known classes of dyes which sensitize silver halide to portions of the infrared region of the electromagnetic spectrum.

With the advent of lasers, and particularly solid state laser diodes emitting in the infared region of the electromagnetic spectrum, the interest in infrared sensitive photographic elements has greatly increased. These infrared emitting diodes have a wide variety of emission wavelengths, the most interesting ranging from about 700 to 900 nm. Typical emission wavelengths include 750 nm, 810 nm, 820 nm, and 870 nm. Many different processes and articles useful with laser diodes have been proposed for a number of applications, such as for making prints from computer assisted tomography and various graphic arts products.

With the increasing popularity of infrared emitting laser diodes as exposure sources for photographic elements, it is desiderable to provide silver halide materials offering an increased exposure latitude upon exposure to said diodes, and higher maximum density upon photographic processing.

The following is a description of the prior art, cited with reference to the present invention.

Silica (silicon dioxide) has been widely disclosed for use as matting agent in photographic elements, as described for example in U.S. Pat. Nos. 3,411,907; 4,409,322; 4,499,179; in EP Pat. Applications Nos. 395,956 and 404,091 and in Japanese Pat. Applications Nos. 62005-235 and 60188-942. Typically, silica used as matting agent has grain size of 0.1 micrometers or more. U.S. Pat. No. 4,711,838 describes silver halide photographic materials for laser exposure to near infrared containing, in a top coat layer and/or a backing layer, surface roughening agents (including silica) having average particle sizes in the range from 0.1 to 1.5 micrometers, to prevent formation of non-contact interference fringes.

Colloidal silica (i.e., silica having grain size below 0.1 micrometers) has been widely described as antistatic compound for use in photographic elements comprising a photosensitive layer and an antistatic layer coated on the film base on the side opposite to a that of the photosensitive layer, as described for example in U.S. Pat. No. 3,525,621 and in EP Pat. Applications 296,656 and 334,400.

Colloidal silica has been also widely disclosed for use in protective layers of photographic elements for reducing scratching, glossiness or adhesion, as described for example in U.S. Pat. Nos. 4,232,117; 4,264,719; 4,777,113 and 4,985,394 and in Japanese Pat. Application No. 03168-637.

SUMMARY OF THE INVENTION

The present invention relates to infrared sensitive photographic elements comprising an opaque film support, an infrared sensitized silver halide emulsion layer and a hydrophilic colloid protective layer coated on one side of the film support, in which the protective layer comprises colloidal silica having an average particle size lower than 15 nanometers.

This invention provides negative acting, high contrast infrared papers and opaline films for laser imagesetters which use an infrared laser diode exposure, and produces high quality laser generated graphic, type and halftones with improved optical density and exposure latitude.

DETAILED DESCRIPTION OF THE INVENTION

The colloidal silica used in this invention is an aqueous dispersion of silicon dioxide particles having an average particle size lower than 15 nanometers. Colloidal silica is described in detail in, for example, *Surface and Colloid Science*, Volume 6, pages 3 to 100, by E. Matijevic (John Wiley & Sons, 1973). In addition to silicon dioxide particles, colloidal silica may contain, as minor components (e.g., in an amount of about 2% by weight or less of the total silicon dioxide present), other compounds, such as alumina, sodium aluminate, inorganic bases (e.g., sodium hydroxide, potassium hydroxide, lithium hydroxide, ammonium hydroxide) or organic salts (e.g., tetramethylammonium salts).

Specific examples of the colloidal silica usable in this invention include commercially available products, such as the Snowtex series, trade name manufactured by Nissan Chemicals Industies, Ltd.; Ludox series, trade name manufactured by E. I. Du Pont de Nemours & Co.; Syton series, trade name manufactured by Monsanto Co,; Nalcoag series, trade name manufactured by Nalco Chem. Co.; Kieselsol series, trade name manufactured by Farbenfabriken Bayer AG; and similar commercially available colloidal silicas, provided that silicon dioxide particles have an average particle size lower than 15 nanometers.

The amount of colloidal silica to be used in the present invention ranges from about 20 to 70% and preferably from about 30 to 50% based on the weight of the hydrophilic colloid of the protective layer in which the colloidal silica is to be incorporated. As a coating amount, colloidal silica is present in an amount of from about 0.1 to 0.6 $g/m^2$, preferably from about 0.2 to about 0.4 $g/m^2$.

Gelatin is the preferred hydrophilic colloid of the protective layer of the photographic element of present invention. Examples of gelatin which can be employed include any gelatin materials known in this field, such as acid-processed gelatin, alkali-processed gelatin, enzyme-processed gelatin, modified gelatin and gelatin derivatives. In addition to gelatin, the protective layer of the photographic element of the present invention, can contain as hydrophilic colloids protein derivatives, cellulose compounds, saccharide derivatives, synthetic polymers and copolymers, which are ordinarily employed in the photographic art in addition to gelatin.

The protective layer of the photographic element of the present invention can contain conventional surface active agents, matting agents, hardeners, slip agents, ultraviolet absorbers, filter dyes, and the like, as known in the photographic art.

The film support used in the photographic element of the present invention is an opaque film support, i.e., a support that is substantially incapable of transmitting radiation or visible light. In said photographic element the images obtained in the developed and fixed gelatin silver halide layer are inspected by reflectance of the opaque support carrying the image layer. Preferably the opaque film support is the paper which is ordinarily employed in the photographic art, such as baryta coated paper and resin coated paper. Other opaque supports can be used in the present invention, such as synthetic resin films having the external appearance and functional characteristics of photographic paper. Composition and manufacture of said opaque supports are described, for example, in U.S. Pat. Nos. 3,579,609; 3,944,699 and 4,187,113 and in GB Pat. Nos. 1,289,555 and 1,360,240. Generally, said synthetic resin films comprise a blend of a polyester and a polyolefine coestruded as a film in the presence of an opacifying pigment, such as barium sulfate, titanium dioxide, barium stearate, alumina, zirconium oxide, kaolin or mica. The amount of opacifying pigment employed can be any amount which is sufficient for the intended use of providing no substantial transmission of radiation or visible light.

The silver halide emulsions used in the photographic element of the present invention include gelatin and silver halide grains dispersed therein associated with sensitizing dyes to make them sensitive to infrared radiation. Said dyes include two nitrogen-containing heterocyclic nuclei linked to each other through a conjugated methine chain to form an amidinium-ion resonance system characterized by the fact that such chain has 7, 9 or 11 carbon atoms.

Exemplary infrared sensitizing dyes for use in this invention can be usefully described by making reference to the following structural formulae:

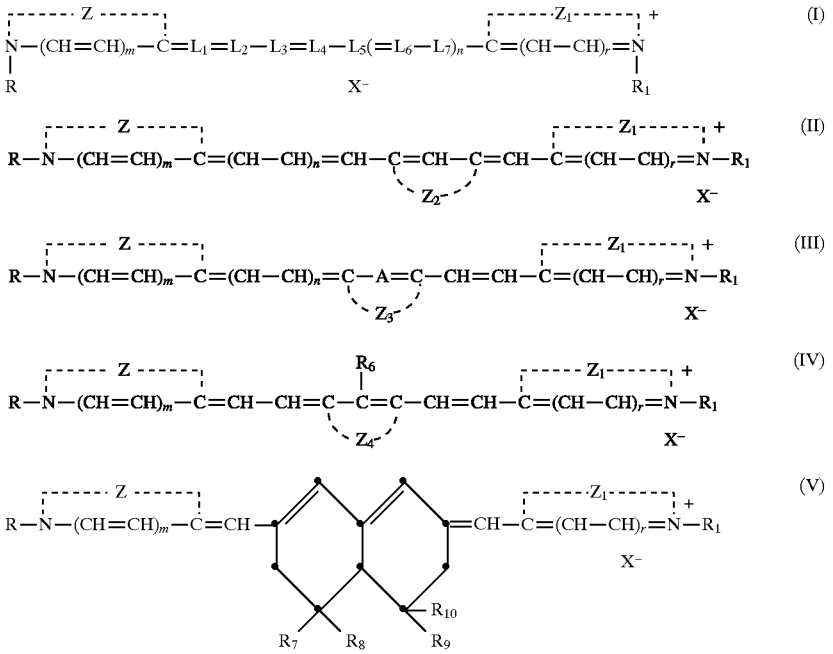

In the formulae above, R and $R_1$ each independently represents substituted or unsubstituted alkyl, preferably of from 1 to 8 carbon atoms, e.g., methyl, ethyl, propyl, butyl, and the like. R and $R_1$ may be each substituted with any of a number of known substituents, such as sulfo, carboxy, cyano, halogen (e.g., fluoro, chloro), hydroxy, alkenyl (e.g., allyl, 2-carboxyallyl), alkoxy (e.g., methoxy, ethoxy), aryl (e.g., phenyl, p-sulfophenyl), and others known to those skilled in the art.

X represents a counterion necessary to balance the charge of the dye molecule. The counterion may be ionically complexed to the molecule or it may be part of the dye molecule itself to form an intramolecular salt. Such counterions are well known in the art. For example, when X is an anion (e.g., when R and $R_1$ are unsubstituted alkyl), examples of X include chloride, bromide, iodide, perchlorate, sulfamate, thiocyanate, p-toluenesulfonate, methylsulfate, and the like. When x is a cation (e.g., when R and $R_1$ are both sulfoalkyl or carboxyalkyl), examples of X include sodium, potassium, triethylammonium, and the like.

Z and $Z_1$ each independently represents the non-metallic atoms necessary to complete a substituted or unsubstituted 5- or 6-membered heterocyclic nucleus chosen within the group of those known in the art to make sensitizing dyes including an amidinium-ion resonance system. The present invention refers particularly to sensitizing dyes including heterocyclic nuclei chosen within those of the thiazole series, benzothiazole series, naphthothiazole series, oxazole series, benzoxazole series, naphthoxazole series, selenazole series, benzoselenazole series, naphthoselenazole series, thiazoline series, oxazoline series, selenazoline series, 2-quinoline series, 4-quinoline series, 2-pyridine series, 4-pyridine series, 3,3-dialkylindolenine series, imidazole series and benzimidazole series. These nuclei may be substituted with known substituents, such as halogen (e.g., chloro, fluoro, bromo), alkoxy (e.g., methoxy, ethoxy), alkyl (e.g., methyl, ethyl), aryl (e.g., phenyl), aralkyl, alkaryl (e.g., benzyl), sulfo, carboxy, cyano, and others known to those skilled in the art.

$L_1$, $L_2$, $L_3$, $L_4$, $L_5$, $L_6$ and $L_7$ each independently represents a substituted or unsubstituted methine group. Examples of substituents for such groups include alkyl (preferably of from 1 to 6 carbon atoms, e.g., methyl, ethyl, and the like) and aryl (e.g., phenyl). Additionally, substituents on the methine groups may form bridges linkages. For example, $L_2$ and $L_4$, or $L_4$ and $L_6$ may be bridged to form a 5- or 6-membered substituted or unsubstituted carbocyclic ring. $L_3$ and $L_5$ may be bridged to form a 5- or 6-membered substituted or unsubstituted carbocyclic ring, with $L_4$ preferably substituted with a halogen (e.g., chloro), aryl (e.g., phenyl), alkyl (e.g., methyl), nitrogen-containing heterocyclic ring.

$Z_2$ represents the atoms necessary to complete a 5- or 6-membered carbocyclic ring. The ring may be substituted, as known to those skilled in the art. Examples of substituents include halogen (e.g., chloro, fluoro), substituted or unsubstituted alkyl (e.g., methyl, ethyl, propyl, chloroethyl, benzyl), substituted or unsubstituted aryl (e.g., phenyl, p-chlorophenyl), hydroxy, alkoxy (e.g., methoxy, ethoxy), and the like.

A represents a carbon atom substituted with a disubstituted N atom of formula

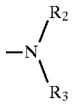

wherein $R_2$ and $R_3$ each independently represents a substituted or unsubstituted alkyl (e.g., methyl, ethyl, propyl, chloroethyl, benzyl), substituted or unsubstituted aryl (e.g., phenyl, m-tolyl, p-chlorophenyl, p-methoxyphenyl), alkoxycarbamyl alkyl (e.g., methoxycarbamylmethyl, ethoxycarbamylethyl), or $R_2$ and $R_3$, taken together, may be the non-metallic atoms necessary to complete a 5- or 6-membered heterocyclic ring (e.g., pyrrolidyl, piperidyl, morpholyl, piperazinyl).

Z3 represents the carbon atoms necessary to form a substituted or unsubstituted 5- or 6-membered carbocyclic ring. The ring may be substituted, as known to those skilled in the art. Examples of substituents include halogen (e.g., chloro, fluoro), substituted or unsubstituted alkyl (e.g., methyl, ethyl, propyl, chloroethyl, benzyl), substituted or unsubstituted aryl (e.g., phenyl, p-chlorophenyl), hydroxy, alkoxy (e.g., methoxy, ethoxy), and the like. The preferred 5-membered carbocyclic ring, including both A and $Z_3$ of formula (III), can be represented by the following formula

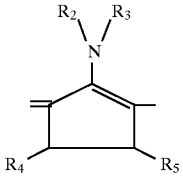

wherein $R_2$ and $R_3$ have the same meaning as before, and $R_4$ and $R_5$ each independently represents a hydrogen atom, an alkyl group (e.g., methyl, ethyl, ethylethoxy), a halogen atom (e.g., chloro, bromo), an alkoxy group (e.g., methoxy, ethoxy, propoxy, butoxy).

$R_6$ represents hydrogen, substituted or unsubstituted alkyl, substituted or unsubstituted aryl, or a substituted or unsubstituted heterocyclic ring that does not have a heteroatom attached directly to the methine chain carbon atom of the dye. Examples of aryl groups useful as $R_6$ include phenyl, naphthyl, tolyl, methoxyphenyl, chlorophenyl, and the like. Examples of alkyl groups include those described above for R and $R_1$. Examples of substituents for alkyl groups are known in the art, e.g., alkoxy and halogen. Examples of heterocyclic rings useful for $R_6$ include 4-pyridyl, 3-pyridyl, 2-thienyl, 3-thienyl, and the like.

$R_7$, $R_8$, $R_9$ and $R_{10}$ each independently represents hydrogen, substituted or unsubstituted alkyl, substituted or unsubstituted aryl, and are preferably hydrogen or methyl. Examples of useful aryl groups include phenyl, tolyl, methoxyphenyl, chlorophenyl, and the like. Examples of alkyl groups include those described above for R and $R_1$. Examples of substituents for alkyl groups are known in the art, e.g., alkoxy and halogen.

In the formulae, m and r are 0 or 1, and n is 1 or 2.

Examples of infrared sensitizing dyes for use in the present invention according to the formulae above are disclosed in U.S. Pat. Nos. 2,104,064; 2,734,900; 2,895,955; 3,128,179; 3,682,630; 4,362,800; 3,582,344; 4,515,888; 4,975,362; 5,013,642; in EP Pat. Applications 420,012 and 420,011; in *Photographic Chemistry*, Vol. 2, P. Glafkides, 1960, Fountain Press, Chapter XL, pages 882–901 and in *The theory of the Photographic Process*, 3rd Ed. Mees and James, 1966, Chapter II, esp. pp. 199 and 205.

The silver halide emulsions used in the present invention are preferably monodispersed, but emulsions having a wide grain size distribution can also be used. The term "monodispersed" refers to an emulsion having a coefficient of variation lower than 45%, preferably lower than 35%, more preferably lower than 20%. The emulsions suitable in the present invention are of the type normally employed to obtain halftone, dot and line, images and are usually called lith emulsions. Lith emulsions contain preferably at least 50 mole % of silver chloride, more preferably at least 80% of silver chloride and at least about 5% mole of silver bromide. If desired, the silver halide grains can contain a small amount of silver iodide, in an amount that is usually less than about 5 mole %, preferably less than 1 mole %. The silver halide grain average size is lower than about 0.7, preferably lower than about 0.4, more preferably lower than 0.2 micrometers. The term "grain size" refers to the diameter of a circle having the area of the same value as the average area projected by the silver halide crystals seen at the electron microscope. The silver halide grains may be those having a regular crystal form, such as a cube or an octahedron, or those having an irregular crystal form, such as a sphere or tablet, etc., or may be those having a composite crystal form. They may be composed of a mixture of grains having different crystal forms.

Gelatin is generally used as hydrophilic colloid for the silver halide photographic elements of the present invention. As hydrophilic colloids, gelatin derivatives, natural substances such as albumin, casein, agar-agar, alginic acid and the like, and hydrophilic polymers such as polyvinyl alcohol, polyvinylpyrolidone, cellulose ethers, partially hydrolized polyvinyl acetate, and the like can be used in addition to or instead of gelatin. Further, gelatin can be partially substituted with polymer latexes obtained by emulsion polymerization of vinyl monomers, such as polyethylacrylate latexes, to improve the physical characteristics of the photographic layers.

The silver halide emulsion may be chemically sensitized with a sulfur sensitizer, such as allylthiocarbamide, thiourea, cysteine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, potassium chloroplatinate, etc. In the present invention, silver halides may be prepared in the presence of at least a doping metallic element of the 8th Group of the Periodic Table of Elements, such as rhodium, iridium and ruthenium, which acts as electron acceptor. Said doping element is preferably chosen among water-soluble iridium salts or water-soluble rhodium salts. Iridium salts include iridium and alkaline metal halides, such as potassium iridium (III) hexachloride and sodium iridium (III) hexabromide. Rhodium salts include rhodium halides, such as rhodium (III) trichloride and rhodium (IV) tetrachloride and rhodium and alkaline metal halides such as potassium rhodium (III) hexabromide and sodium rhodium (III) hexachloride. These salts may be added in a quantity of from $0.5\times10^{-4}$ to $10\times10^{-4}$ moles, and preferably from $2\times10^{-4}$ to $7\times10^{-4}$ moles per mole of silver halide. Each of such sensitizers being employed either alone or in a suitable combination.

The silver halide emulsions can be prepared using a single-jet method, a double-jet method, or a combination of these methods or can be matured using, for instance, an ammonia method, a neutralization method, an acid method, etc. At the end of grain precipitation, water soluble salts are removed from the emulsion with procedures known in the art, such as ultrafiltration. The emulsions can contain optical brighteners, antifogging agents and stabilizers, filtering and antihalo dyes, hardeners, coating aids, plasticizers and lubricants and other auxiliary substances, as those described, for instance, in Research Disclosure 17643, V, VI, VIII, X, XI and XII, December 1978. The above described emulsions can be coated onto several opaque support bases, as described before, by adopting various methods, as described in Research Disclosure 17643, XV and XVII, December 1978.

The above emulsions may also contain various additives conveniently used depending upon their purpose. These additives include, for example, stabilizers or antifoggants such as azaindenes, triazoles, tetrazoles, imidazolium salts, polyhydroxy compounds and others; film hardeners such as of the aldehyde, aziridine, isoxazole, vinylsulfone, acryloyl, triazine type, etc.; developing promoters such as benzyl alcohol, polyoxyethylene type compounds, etc.; image stabilizers such as compounds of the chromane, cumaran, bisphenol type, etc.; and lubricants such as wax, higher fatty acid glycerides, higher alcohol esters of higher fatty acids, etc. Also, coating aids, modifiers of the permeability in the processing liquids, defoaming agents, antistatic agents and matting agents may be used. References for the kind and for the use of these additives can be found in Research Disclosure 308, December 1989, Item 308119, *"Photographic Silver Halide Emulsions, Preparation, Addenda, Processing and System"*.

The present invention does not put any particular restriction on the developing process of the photosensitive material. In general any developing process can be adopted (comprising the developing, fixing and etching steps) which is used to process conventional photographic materials to be used in the lithographic field. Such developing process can be performed manually or by using automatic processors, at a processing temperature generally ranging from 18 to 50° C., but also outside said range, if desired.

The developing solution can contain any known developing agent. Examples of developing agents (which can be used alone or in mixture) comprise the dihydroxybenzenes (e.g., hydroquinone), aminophenoles (e.g., N-methyl-p-aminophenol), 3-pyrazolidones (e.g., 1-phenyl-3-pyrazolidone), ascorbic acid, and the like. Moreover, such developing solutions can contain preservatives, alkali agents, buffering agents, antifoggants, water softening agents, hardeners, and the like. A suitable developing solution which can be used with the photographic material of the present invention is the so-called lith developing solution, which comprises a dihydroxybenzene developing agent, an alkali agent, a small quantity of free sulfite and a buffering agent for the sulfite ions (such as formaline and sodium bisulfite adducts and acetone and sodium bisulfite adducts) to monitor the free sulfite concentration, etc.

The fixing solution can have any conventional composition. Examples of fixing agents which can be used comprise thiosulfates, thiocyanates and sulfur organic compounds, known as fixing agents. The fixing solution can further contain water-soluble aluminum salts as hardeners. The etching solution can have any conventional composition as well, and, for instance, the compositions described by C. E. K. Mees in *"The Theory of the Photographic Process"*, McMillan, 1954, pp. 737–744 and precisely an etching solution can be used which comprises, as a reducing agent, a permanganate, a ferric salt, a persulfate, a cupric acid, a ceric acid, a hexacyanoferate-(III) or a dichromate, alone or in combination and, possibly, an inorganic acid such as sulfuric acid, and an alcohol; or an etching solution can be used which comprises a reducing agent such as a hexacyanoferrate-(III), ethylenediaminotetracetatoferrate-(III) or the like and a silver halide solvent such as thiosulfate, thyocyanate, thiourea or a derivative thereof and, possibly, an inorganic acid such as sulfuric acid. Representative examples of etching solutions are Farmer's solutions comprising potassium ferrocyanide and sodium thiosulfate, an etching solution comprising persulfate, an etching solution comprising a ceric salt, etc.

The present invention is now illustrated with more details by making reference to the following example.

EXAMPLE

A silver nitrate aqueous solution, a potassium bromide aqueous solution and a potassium chloride aqueous solution were added to an aqueous gelatin solution kept at 50° C. in the presence of potassium iridium (III) hexachloride and potassium ruthenium (III) pentachloride to prepare a silver chlorobromide emulsion having an average grain size of 0.2 micrometers and an average silver chloride content of 60%.

The resulting emulsion was washed by the ultrafiltration method to remove any soluble salts, then chemically sensitized with sodium thiosulfate, sodium p-toluenethiosulfonate and potassium chloroaurate.

The emulsion was added with surfactants, stabilizers, hydroquinone, formaldehyde hardener, the infrared sensitizers

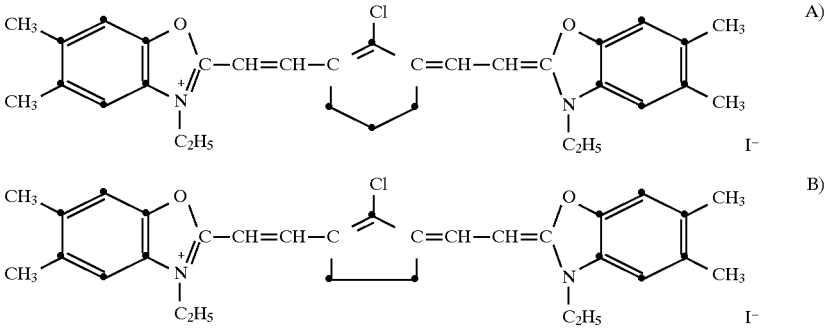

and a bistriazinylaminostilbene fluorescent brightener as supersensitizer.

The emulsion was coated on a gelatin subbed polyethylene coated paper base to a silver coverage of 1.25 g/m$^2$, an infrared sensitizer A coverage of 0.06 mg/m$^2$ and an infrared sensitizer B coverage of 0.12 mg/m$^2$.

Simultaneously with the emulsion layer, a protective layer was coated on the emulsion layer, said protective layer comprising gelatin at a coverage of 0.7 g/m$^2$ surfactants, formaldehyde hardener, silica having average particle size of 5 micrometers as matting agent at a coverage of 7 mg/m$^2$ and a blue-green dye.

Other infrared sensitive materials were obtained following the procedure above adding 0.357 g per g of gelatin of different colloidal silicas, as reported in the following table, in the protective layer of each material.

Samples of the infrared sensitive materials were exposed in a Linotype Linotronic 200 SQ imagesetter equipped with an infrared laser diode exposure source operating at 780 nm (having a resolution from 635 to 1693 dots per inch and a laser density from 1 to 999 units) and processed in a 3M RA 66 processor using the 3M RDC V lith processor developer for 30 seconds at 35 C, then fixed.

The following Table reports the colloidal silicas used in the protective layer (Coll. Sil.) and their mean particle sizes (nm), the values of fog (Dmin), maximum optical density (Dmax) of the processed samples and the exposure latitude (Exp) expressed as laser units used to obtain a good text and line quality respectively at high resolution (1963 DPI) and low resolution (635 DPI).

TABLE

| | | | | | Exp | |
|---|---|---|---|---|---|---|
| Film | Coll. Sil. | nm | Dmin | Dmax | High Res. | Low Res. |
| 1 | — | — | 0.07 | 1.83 | 200 | not val. |
| 2 | Ludox SM | 7–8 | 0.07 | 2.00 | 200–300 | 650–850 |
| 3 | Ludox AM | 13–14 | 0.07 | 1.96 | 200–300 | 550–650 |
| 4 | Ludox LS | 15–16 | 0.07 | 1.92 | 150–250 | 650 |
| 5 | Ludox TM | 22–25 | 0.07 | 1.85 | 150–250 | 650 |

The results show the surprising result of colloidal silicas having an average particle size lower than 15 nm on the maximum optical density and the exposure latitude both at high and low resolution. The same effect has not resulted when coating the emulsion and the protective layer containing the colloidal silica on a transparent film support, such as a polyethyleneterephthalate film support.

We claim:

1. An infrared sensitive photographic element comprising an opaque film support, an infrared sensitized silver halide emulsion layer and a hydrophilic colloid protective layer on one side of the film support, characterized in that the protective layer comprises colloidal silica having an average particle size lower than 15 nanometers wherein the colloidal silica is present at a coverage of from 20 to 70 grams per 100 grams of the hydrophilic colloid in the protective layer.

2. An infrared sensitive photographic element according to claim 1, wherein the hydrophilic colloid is gelatin.

3. An infrared sensitive photographic element according to claim 1, wherein the colloidal silica is present at a coverage of 0.1 to 0.6 grams per square meter.

4. An infrared sensitive photographic element according to claim 1, wherein the opaque film support is a resin coated paper.

5. An infrared sensitive photographic element according to claim 1, wherein the silver halide emulsion includes gelatin and silver halide grains dispersed therein associated with sensitizing dyes to make them sensitive to infrared radiation, said sensitizing dyes being represented by the formula

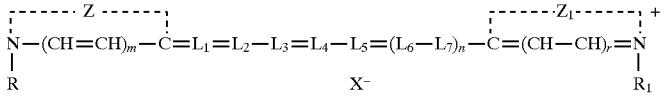

wherein

R and $R_1$ represents a substituted or unsubstituted alkyl group,

Z and $Z_1$ each independently represents the non-metallic atoms necessary to complete a 5- or 6-membered substituted or unsubstituted heterocyclic nucleus of the type used in cyanine dyes, $L_1$, $L_2$, $L_3$, $L_4$, $L_5$, $L_6$ and $L_7$ each represents a substituted or unsubstituted methine group, m and r are 0 or 1, n is 1 or 2 and X is a counterion.

6. An infrared sensitive photographic element according to claim 1, wherein the silver halide emulsion includes gelatin and silver halide grains dispersed therein associated with sensitizing dyes to make them sensitive to infrared radiation, said sensitizing dyes being represented by the formulae

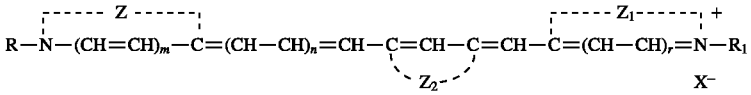

wherein

R and $R_1$ each represents a substituted or unsubstituted alkyl group,

Z and $Z_1$ each independently represents the non-metallic atoms necessary to complete a 5- or 6-membered substituted or unsubstituted heterocyclic nucleus of the type used in cyanine dyes, $Z_2$ represents the atoms necessary to complete a 5- or 6-membered substituted or unsubstituted carbocyclic ring, X is a counterion, n is 1 or 2 and m and r are each 0 or 1, and

7. An infrared sensitive photographic element according to claim 1, wherein the silver halide emulsion includes gelatin and silver halide grains dispersed therein associated with sensitizing dyes to make them sensitive to infrared radiation, said sensitizing dyes being represented by the formula

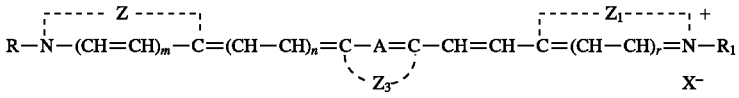

wherein

R, $R_1$, m, n, r and X have the same meaning as before, A represents a carbon atom substituted with a N atom,

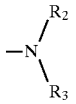

$R_2$ and $R_3$ each independently being a substituted or unsubstituted alkyl group, an alkoxycarbamylalkyl group, a substituted or unsubstituted aryl group, and $Z_3$ means the carbon atoms necessary to form a 5-carbon rigidized nucleus represented by the following formula

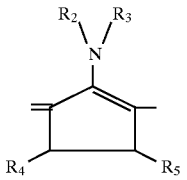

wherein $R_2$ and $R_3$ have the same meaning as before, and $R_4$ and $R_5$ each represents a hydrogen atom, an alkyl group, a halogen atom, an alkoxy group.

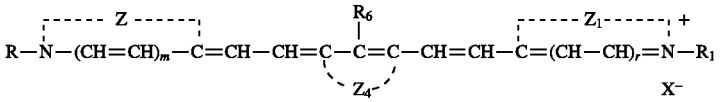

wherein

R and $R_1$ each represents a substituted or unsubstituted alkyl group,

Z and $Z_1$ each independently represents the non-metallic atoms necessary to complete a 5- or 6-membered substituted or unsubstituted heterocyclic nucleus of the type used in cyanine dyes, $Z_4$ represents the atoms necessary to complete a 5- or 6-membered carbocyclic ring, $R_6$ represents hydrogen, substituted or unsubstituted alkyl group, substituted or unsubstituted aryl group, or a substituted or unsubstituted heterocyclic group, X is a counterion, and m and r are each 0 or 1.

8. An infrared sensitive photographic element according to claim 1, wherein the silver halide emulsion includes gelatin and silver halide grains dispersed therein associated with sensitizing dyes to make them sensitive to infrared radiation, said sensitizing dyes being represented by the formula

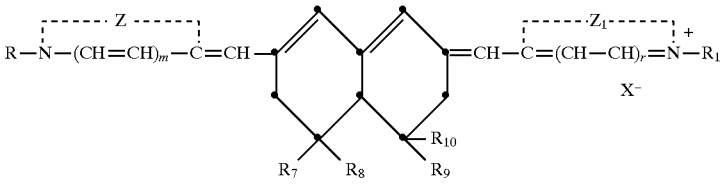

wherein

R and $R_1$ each represents a substituted or unsubstituted alkyl group,

Z and $Z_1$ each independently represents the non-metallic atoms necessary to complete a 5- or 6-membered substituted or unsubstituted heterocyclic nucleus of the type used in cyanine dyes, $R_7$, $R_8$, $R_9$ and $R_{10}$ each independently represents hydrogen, substituted or unsubstituted alkyl group, substituted or unsubstituted aryl group, X is a counterion, and m and r are 0 or 1.

* * * * *